US006974662B2

(12) United States Patent
Goswami et al.

(10) Patent No.: US 6,974,662 B2
(45) Date of Patent: Dec. 13, 2005

(54) THERMAL BASE PRECURSORS

(75) Inventors: Ramanuj Goswami, Webster, NY (US); Wojciech K. Slusarek, Rochester, NY (US); David H. Levy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/634,429

(22) Filed: Aug. 4, 2003

(65) Prior Publication Data

US 2005/0032009 A1 Feb. 10, 2005

(51) Int. Cl.[7] ..... G03C 1/498; G03C 1/815; G03C 5/16

(52) U.S. Cl. ..... 430/350; 430/21; 430/510; 430/513; 430/529; 430/607; 430/619; 430/631; 430/955; 430/956; 430/957; 430/964

(58) Field of Search ..... 430/21, 350, 513, 430/616, 529, 619, 955, 959, 957, 956, 964, 631, 621, 607, 510

(56) References Cited

U.S. PATENT DOCUMENTS 4,060,420 A 11/1977 Merkel et al.
4,731,321 A 3/1988 Sato et al.
4,981,965 A 1/1991 Yabuki et al.
5,314,795 A * 5/1994 Helland et al. ..... 430/517

FOREIGN PATENT DOCUMENTS

EP 0 708 086 B1 5/1998

OTHER PUBLICATIONS

C. Handsch and A.J. Leo, in "Substituent Constants for Correlation Analysis in Chemistry and Biology", Willey, New York, 197.*

STIC Search Report, pp. 1–8.*

* cited by examiner

*Primary Examiner*—Thorl Chea
(74) *Attorney, Agent, or Firm*—Chris P. Konkol

(57) ABSTRACT

Improved compounds and base precursors that undergo thermal decomposition are disclosed. Thermal base precursors, and in particular, a novel class of salts of arylsulfonylacetic acids as bleaching agents or promoting for photothermographic use are disclosed. Compositions employing these thermal base precursors are suitable for use in acutance and antihalation systems, bleachable filter dye materials, and in promoting unblocking of various components such as blocked developers, especially in photothermographic elements.

25 Claims, No Drawings

THERMAL BASE PRECURSORS

FIELD OF THE INVENTION

This invention relates to improved thermal base precursors. Such compounds can be used, for example, in thermally bleachable filter dye compositions in imaging elements.

BACKGROUND OF THE INVENTION

A thermal base precursor is a neutral or weakly basic compound that can generate a strong base during thermal processing. Various base precursors are known as, for example, described in U.S. Pat. Nos. 3,220,846, 4,060,420 and 4,731,321. Japanese Patent Application No. 1-150575 describes thermally-releasable bis-amines in the form of their bis(aryl sulfonylacetic acid)salts. Other amine-generating compounds include 2-carboxycarboxamide derivatives disclosed in U.S. Pat. No. 4,088,469, hydroxime carbamates disclosed in U.S. Pat. No. 4,511,650 and aldoxime carbamates disclosed in U.S. Pat. No. 4,499,180. Examples of some thermal base precursors are shown in Table III of U.S. Pat. No. 5,258,274 to Helland et al., including cations and anions, which patent is incorporated by reference.

Further examples of base precursors include salts of carboxylic acids and organic bases as described in U.S. Pat. No. 3,493,374 (triazine compounds and carboxylic acids), British Patent 998,949 (trichloroacetic acid salts), U.S. Pat. No. 4,060,420 (sulfonylacetic acid salts), JP-A-59-168441 (The term "JP-A" as used herein means an "unexamined published Japanese patent application") (sulfonylacetic acid salts), JP-A-59-180537 (propionic acid salts), JP-A60-237443 (phenylsulfonylacetic acid salts substituted by a sulfonyl group), and JP-A-61-51139 (sulfonylacetic acid salts).

Base precursors consisting of carboxylic acids and organic di or tetra-acidic bases are disclosed in JP-A-63-316760 and JP-A-1-68746 (corresponding to U.S. Pat. No. 4,981,965). In these base precursors, the activity on heat treatment at 140° C. is compatible with the storability. EP0708086 discloses selected base precursors that simultaneously provide both satisfactory storability and activity on heat treatment at 120° C. or less. These base precursors can be employed when it is desirable to rapidly release a base at a low heating temperatures while maintaining good storability prior to thermal processing. Such bisguanidine salts are selected from the group consisting of a 4-(phenylsulfonyl) phenylsulfonylacetic acid salt of N,N'bis(1,3-diethylguanyl) ethylenediamine, a 4(phenylsulfonyl)phenylsulfonylacetic acid salt of N,N'-bis(1,3diisopropylguanyl)ethylenediamine, 4(phenylsulfonyl)phenylsulfonylacetic acid salt of N,N'-bis-(imidazoline-2yl)ethylenediamine, and other specified compounds.

A base precursor typically has an inherent decomposition point. However, in practical applications, rapid decomposition of the base precursor (the release of the base) is expected only at heating temperatures much higher than its decomposition point. For example, although ease of the decomposition also is dependent on methods of heating, a base precursor having a decomposition point of about 100° C. or less might be subjected to a heating temperature of 120° C. in order to obtain rapid decomposition.

U.S. Pat. No. 4,981,965, hereby incorporated by reference, describes base precursors comprising arylsulfonylacetic acid salts of guanidine bases. Such base precursors have a stable crystal structure, which crystal structure is kept until it melts or is dissolved at an elevated temperature. At the same time that the crystal structure is broken, the carboxylic acid is rapidly decarboxylated to release a base. In these systems, thermolysis of the salt results in decarboxylation to form an arylsulfonylmethyl anion. This anion abstracts a proton from the guanidinium salt to release the free base. This base can then provide the alkalinity required for a number of image-forming processes.

U.S. Pat. No. 4,060,420, hereby incorporated by reference, describes the use of ammonium salts of arylsulfonylacetic acids as activator-stabilizers in photothermographic systems. In these systems the ammonium species is always a protonated basic nitrogen, and thus has at least one labile hydrogen atom. U.S. Pat. No. 4,731,321 discloses ammonium salts of arylsulfonylacetic acid as base precursors in heat-developable light-sensitive materials.

Japanese Patent Application No. 1-150575 discloses thermally releasable bisamines in the form of their bis (arylsulfonylacetic acid) salts. Other amine-releasing compounds include 2-carboxycarboxamide derivatives disclosed in U.S. Pat. No. 4,088,496; hydroxylamine carbamates disclosed in U.S. Pat. No. 4,511,650; and aldoxime carbamates disclosed in U.S. Pat. No. 4,499,180.

As indicated above, it is usually desirable for a thermal base precursor to exhibit good stability during storage but to quickly decompose to form a base when it is heated at the temperature of use. A successful base precursor will not have any adverse effects on the imaging element in which it is contained.

Problem to be Solved by the Invention

There is always a need for improved base precursor compositions that can be used to provide a base on thermal activation. Applications include base precursors for permanently and quickly bleaching colored components in imaging elements, for example, prior to scanning. Particularly in the field of color photothermographic capture film, the requirements in terms of bleaching and keeping are high.

A problem with prior-art base precursors when used in a filter layer is that they can cause unacceptable increase of fog densities at the adjacent imaging layers during keeping or during thermal processing. A severe limitation of the prior-art base precursors is the sensitometric degradation of the adjacent imaging layers during keeping or storage, thus rendering such prior-art base precursors useless for consumer photographic films. Thus, there is a need for an improved base precursor in combination with a filter dye (including yellow or magenta filter dyes) that can undergo efficient and irreversible thermal bleaching during thermal processing.

These and other problems may be overcome by the practice of our invention.

SUMMARY OF THE INVENTION

As mentioned above, the present invention is directed to improved thermal base precursors. Such compounds can be used, for example, to provide thermally bleachable filter dye compositions or other components in photothermographic elements or to activate or promote other reactions such as the unblocking of photographically useful compounds such as blocked developers.

In one embodiment, this invention relates to thermally activated dye bleaching agents, and in particular, the salts of arylsulfonylacetic acids as bleaching agents for photothermographic use. Photothermographic elements employing these thermally activated dye bleaching agents are suitable for use in providing acutance, color filtration, and antihalation in imaging materials.

The use of thermally bleachable filter dye compositions according to the present invention can reduce or eliminate the sensitometric damages to the adjacent imaging layers during storage prior to thermal processing. Such bleachable filter dye compositions also can have the advantage of reducing or eliminating Dmin increases in one or more adjacent imaging layers.

In one particular embodiment, the present invention relates to a photothermographic element comprising a support, at least one photothermographic layer, and at least one color filter layer, wherein the filter layer comprises a heat-bleachable composition comprising at least one light-absorbing filter dye in association with a base precursor according to the present invention. Color filter layers containing the compositions of the present invention may be used as antihalation layers, magenta filter layers, and yellow filter layers. The compositions of the present invention can be used in other layers for light-absorption purposes, for example, in an imaging layer.

The term "filter dye" encompasses dyes used in filter layers or antihalation layers and excludes dyes resulting from developing agents or coupling agents. In one embodiment of the invention, the filter dye is in the form of particles that are dispersed in a matrix comprising a hydrophilic polymer or water-dispersible hydrophobic polymer.

The invention is also directed to a method of processing a photothermographic element and the use of the photothermographic element, wherein a filter layer becomes at least 40%, preferably at least 50%, more preferably at least 90%, colorless within about 20 minutes, preferably within about 5 minutes, more preferably within about 0.5 minutes, upon heating to a temperature of at least about 90° C. (according to controlled tests of such a layer essentially alone on the same support used in the product). The described filter layer is especially advantageous because of the speed with which the layer becomes at least 40% colorless upon heating and its good storage stability prior to thermal processing. Preferred embodiments provide thermal bleaching of greater than 50% in less than 20 seconds at a temperature below 175° C.

The invention is also directed to a method of forming an image in the photothermographic element, including scanning the developed image.

DETAILED DESCRIPTION OF THE INVENTION

The base precursors of the present invention are useful in photothermographic materials which usually contain various layers and components, including imaging layers, filter layers, overcoats and the like. The base precursors comprise novel arylsulfonylacetic acid salts of guanidine bases.

One aspect of the present invention is directed to a base precursor comprising a salt of an organic base with an arylsulfonylacetic acid, the latter acid having the following structure:

(I)

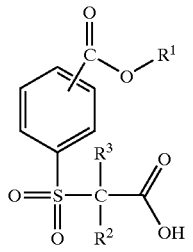

wherein the group $R^1$ represents a substituted or unsubstituted alkyl group (preferably having 1 to 30 carbon atoms), cycloalkyl group, aralkyl group, aryl group or heterocyclic group.

In the above Structure (I), each of $R^2$ and $R^3$ is independently a monovalent group such as hydrogen, an alkyl group, an alkenyl group, a cycloalkyl group, an aralkyl group, an aryl group and a heterocyclic group. Each of the monovalent groups may have one or more substituent groups. Among them, hydrogen, an alkyl group and an aryl group are preferred, and hydrogen is particularly preferred. Each of the alkyl group, the alkenyl group and the alkenyl group preferably has 1 to 8 carbon atoms.

In general, when reference in this application is made to a particular moiety or group it is to be understood that such reference encompasses that moiety whether unsubstituted or substituted with one or more substituents (up to the maximum possible number). For example, "alkyl" or "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; hydroxy; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted or unsubstituted alkenyl, preferably of 2 to 10 carbon atoms (for example, ethenyl, propenyl, or butenyl); substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; hydroxylate, amino, alkylamino, cyano, nitro, carboxy, carboxylate, acyl, alkoxycarbonyl, aminocarbonyl, sulfonamido, sulfamoyl, sulfo, sulfonate, alkylammonium, and an ionizable group with a pKa value below 4 in water; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Some examples of specific arylsulfonylacetic acid according to the invention are as follows:

A-1

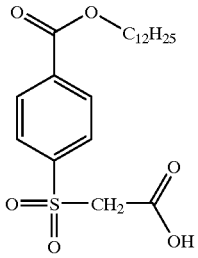

A-2

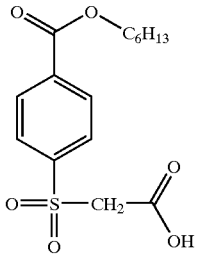

A-3

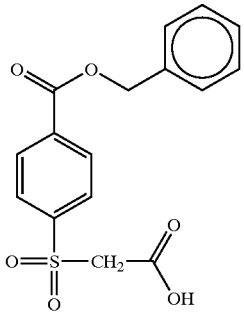

A-4

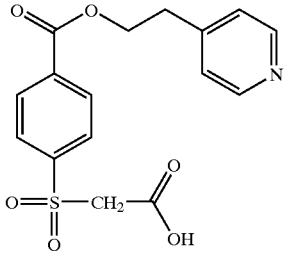

A-5

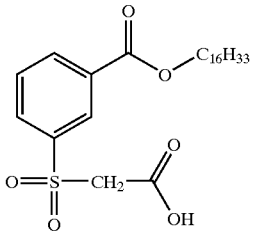

A-6

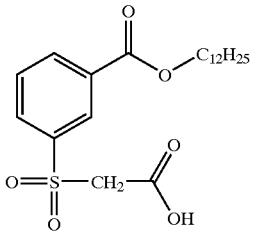

-continued

A-7

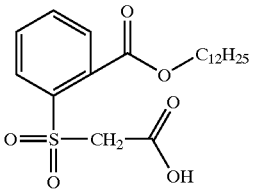

A-8

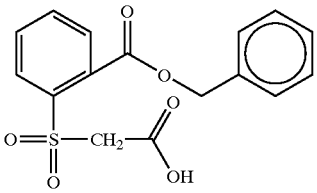

A-9

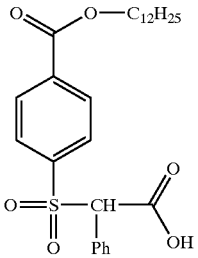

These carboxylates undergo decarboxylation on heating thereby generating the arylsulfonylmethide carbanions. These carbanions in turn can abstract the acidic protons from guanidinium moieties whereby strongly basic guanidines are released. At elevated temperature, the base precursor composed of a carboxylic acid according to the present invention and an organic base can melt or dissolve in a binder contained in an imaging material at which time decarboxylation of the carboxylic acid can occur.

The carboxylic acid of the base precursor of the present invention should have such a property that the carboxyl group undergoes decarboxylation under the conditions of intended use. In the case that the base precursor of the present invention is used for a heat developable imaging material, it is preferred that the carboxyl group undergoes decarboxylation at an elevated temperature in the range of 80° to 250° C., and more preferably in the range of 110° to 200° C.

In one embodiment of the base precursor of the present invention, the organic base (that forms a salt with the carboxylic acid of Structure I above) is a diacidic to tetraacidic base having the following Structure (II).

$$R^{13}(—B)_n \qquad (II)$$

In the Structure (II), $R^{13}$ is an n-valent residue of a hydrocarbon or heterocyclic ring, each of which may have one or more substituent groups. The subscript "n" is an integer of 2 to 4. Preferably "n" is is 2. When "n" is 2, it is preferred that the divalent residue of the hydrocarbon, which may constitute $R^{13}$, is an alkylene group (more preferably having 1 to 6 carbon atoms) or an arylene group (more preferably, phenylene). An example of the residue of the heterocyclic ring, which may constitute $R^{13}$, is a residue derived from pyridine ring.

The organic base preferably has a symmetrical chemical structure. Thus, it is particularly preferred that the diacidic to tetraacidic base having the Structure (III) is symmetrical. In reference to structure Structure (II), the term "symmetrical organic base" means that all of the groups represented by "B" are equivalent in the molecular structure of the organic base.

In the Structure (II), the group represented by "B" is preferably a monovalent group corresponding to an atomic group formed by removing one hydrogen atom from a "guanidine moiety" in which the organic base has two to four guanidine moieties in its molecular structure. The "guanidine moiety" corresponds to an atomic group formed by removing one or two hydrogen atoms from a compound (guanidine or a guanidine derivative) having the following Structure (III):

(III)

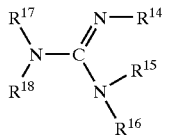

In the Structure (III), each of $R^{14}$, $R^{15}$, $R^{16}$, $R^{17}$ and $R^{18}$ are independently a monovalent group such as hydrogen, an alkyl group, an alkenyl group, an alkynyl group, a cycloalkyl group, an aralkyl group, an aryl group and a heterocyclic group. Each of the monovalent groups may have one or more substituent groups. Each of the alkyl group, alkenyl group, alkynyl group, cycloalkyl group, aralkyl group, aryl group and heterocyclic group preferably has 1 to 6 carbon atoms (including carbon atoms contained in substituent groups). Hydrogen, an alkyl group, a cycloalkyl group, an aralkyl group and an aryl group are preferred. Hydrogen and an alkyl group are more preferred. Hydrogen is most preferred. An example of the cycloalkyl group is cyclohexyl. An example of the aralkyl group is benzyl. An example of the aryl group is phenyl.

Any two of $R^{14}$, $R^{15}$, $R^{16}$, $R^{17}$ and $R^{18}$ may be combined together to form a five-membered or a six-membered nitrogen-containing heterocyclic ring. The heterocyclic ring preferably consists of nitrogen and carbon atoms. In other words, the five or six members of the ring preferably are only nitrogen and carbon atoms.

It is particularly preferred that the organic base or compound having the Structure (II) above is guanidine (having no substituent group), more preferably, a diacidic to tetraacidic base that is composed of two to four guanidine moieties corresponding to an atomic group formed by removing one or two hydrogen atoms from the above-mentioned compound having the Structure (III) and at least one linking group for the guanidine moieties.

The linking group is a residue of a hydrocarbon or a heterocyclic ring. The hydrocarbon may be a linear aliphatic, alicyclic or aromatic compound. Examples of the heterocyclic ring include pyridine and triazine. The linking group may have one or more substituent groups.

Examples of the substituent group include an alkyl group (preferably having 1 to 6 carbon atoms), an alkoxy group (preferably having 1 to 6 carbon atoms), a halogen atom and hydroxyl. The linking group preferably has 1 to 10 carbon atoms (including carbon atoms contained in substituent groups), more preferably has 1 to 8 carbon atoms, and most preferably has 1 to 6 carbon atoms.

The guanidine moiety preferably is a monovalent substituent group of a hydrocarbon or heterocyclic ring, as shown in the Structure (III) above. In other words, it is preferred that the guanidine moiety corresponds to an atomic group formed by removing one hydrogen atom from an guanidine having the Structure (III), but the guanidine moiety may correspond to an atomic group formed by removing two hydrogen atoms from such guanidine. In this case, the organic base may be in the form of a nitro-containing heterocyclic ring (e.g., a pyperazine ring).

Examples of the organic base that can be used in the base precursor of the present invention are given in U.S. Pat. No. 4,981,965, hereby incorporated by reference in its entirety.

In one preferred embodiment of the present invention, the organic base is a bisguanidinium salt having the following formula:

IIIA

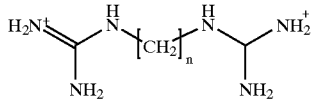

wherein n is 2, 3 or 4.

Examples of some preferred salts of organic bases are the following:

B-1

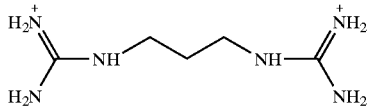

B-2

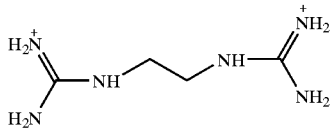

B-3

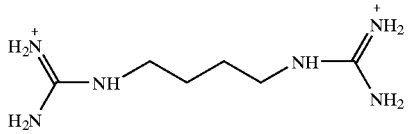

In one preferred embodiment of the invention, base precursors according to the present invention can be represented by the following Structure (IIIB):

IIIB

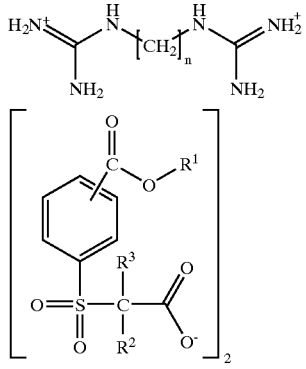

wherein n is 2, 3, or 4 and $R^1$, $R^2$ and $R^3$ are as defined above with respect to Structure (I).

Some examples of some specific preferred base precursors are as follows:

BP-1

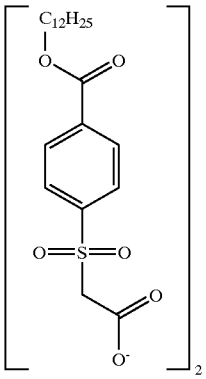

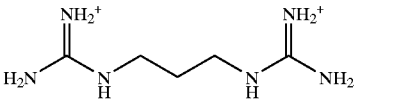

BP-2

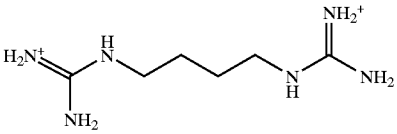

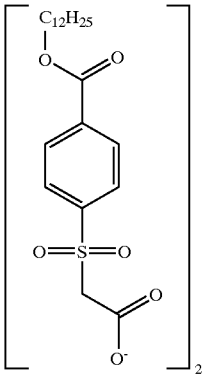

BP-3

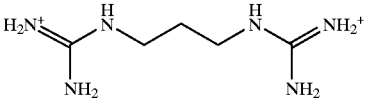

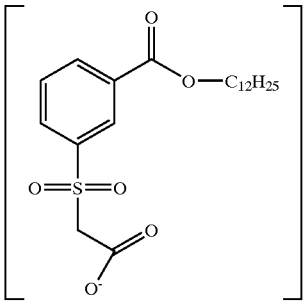

BP-4

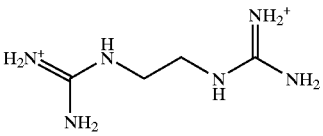

-continued

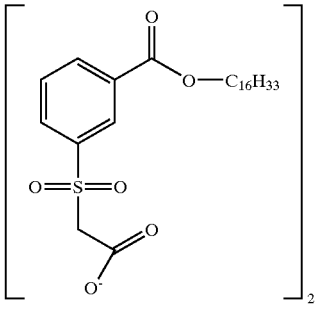

BP-5

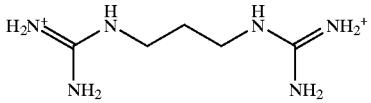

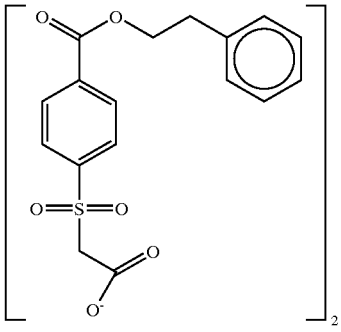

BP-6

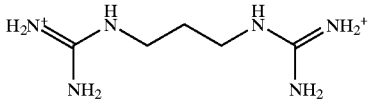

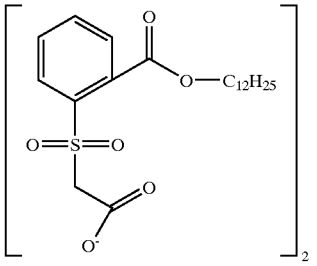

In one embodiment of the invention, base precursors in accordance with the present invention are useful for promoting reactions that require an alkaline environment, for example the unblocking of a blocked photographically useful compound. Such compounds include, but are not limited to, couplers, development inhibitors, bleach accelerators, bleach inhibitors, inhibitor releasing developers, dye precursors, developing agents, electron transfer agents, silver halide solvents, silver halide complexing agents, reductones, image toners, pre-processing or post-processing image stabilizers, hardeners, or precursors thereof.

In one embodiment of the invention, base precursors in accordance with the present invention are useful in a filter layer of a photothermographic or photographic element to absorb light of a color not completely absorbed by a color layer or color layer unit above the filter layer, while transmitting light of a color intended to be absorbed by a color layer or a color layer below the filter layer. A filter layer will typically employ a filter dye, which absorbs, or filters out, light not intended to be absorbed by a color layer. An antihalation layer can be viewed as a type of filter layer positioned below all the color layers, although no light needs to be transmitted to any color layer below the antihalation layer. In any case, however, it is necessary that passage of light through the antihalation unit (namely, back through the antihalation unit by reflection) is prevented or minimized. Thus, it may be said that filter-dye compositions absorb light from different regions of the spectrum, such as red, blue, green, ultraviolet, and infrared, to name a few, and that such filter-dye compositions perform the function of absorbing light during exposure of the material so as to prevent or at least inhibit light of a specific spectral region from reaching at least one of the radiation sensitive layers of the element. Dyes are also used in photographic materials as filters, typically located in overcoats or interlayers, to absorb incident radiation and improve image sharpness.

It is generally desirable for both photothermographic and conventional wet-processed films to employ light-filtering filter-dye compositions that can be quickly and readily rendered ineffective, i.e., decolorized or destroyed or removed, either prior to, during, or after photographic processing.

Imaging elements that can be processed, after imagewise exposure, by heating the element are referred to as photothermographic elements. Although not essential, it would be desirable for a filter layer in a photothermographic element to be capable of being rendered substantially decolorized upon heat processing in order to avoid unwanted absorption of light during subsequent scanning. Such unwanted absorption might otherwise cause an undesirably higher level of minimum density (an increased "$D_{min}$"). Particularly in the case of a photothermographic film intended for scanning subsequent to thermal processing, bleaching a filter layer to colorless or less colored and avoiding or minimizing any unnecessary non-image density is especially desirable.

The de-coloration or destruction of a light-absorbing dye will hereinafter be referred to as bleaching. In the case of photothermographic films, which are processed in the absence of processing baths, in the simplest case the bleaching must occur by heating.

Prior-art dyes having desirable absorption characteristics for use as a filter dye have not always had good thermal-bleaching characteristics. Visible images made from photographic elements containing such dyes have been subject to undesirable stains. Other prior-art thermally bleachable dye compositions have not had the desired stability that is required for normal storage of the photographic element, particularly when such dyes are used in combination with a base precursor subject to premature base release. Many otherwise dry photographic processes (i.e., those photographic processes that require no liquids for the preparation of a visible image) have employed light-absorbing dyes that could only be removed by subjecting them to some form of liquid treatment for example, an acid bath or an alkaline bath. However, many of these otherwise dry processes lose their attractiveness when liquids are required for dye removal. Typical processes employing prior-art light-absorbing layers are described in U.S. Pat. No. 3,260,601 and U.S. Pat. No. 3,282,699, herein incorporated by reference.

Dark keeping is a particularly challenging problem for a thermally bleachable dye composition in the case of a photothermographic color film for consumer use. For such compositions to be useful, it would be crucial that they have the least amount of dark-keeping loss, and at the same time undergo almost complete bleaching at higher temperatures.

A variety of filter compositions have been reported in the literature for use in photothermographic systems, which compositions avoid the use of processing solutions. For example, prior patents or publications of relevance include U.S. Pat. No. 5,312,721, EP 708, 086 A1, EP 911, 693 A1, U.S. Pat. No. 4,981,965, U.S. Pat. No. 5,258,274, U.S. Pat. No. 4,197,131, Research Disclosure, 1978, 170, 40–41, Research Disclosure, 1978, 169, 44–45, Research Disclosure, 16978 (1978), Research Disclosure, 19721 (1980), hereby all incorporated by reference in their entirety.

The use of base precursors for use in combination with filter dyes (in antihalation layers) in photothermographic and thermographic systems are generally known. They can be used in heat processable photosensitive elements that can be constructed so that after exposure, they can be processed in a substantially dry state, or with small amounts of water, by applying heat.

In principle, the dye may be any dye capable of being bleached by the base precursors of the invention.

Bleachable dyes include benzothiazines, cyanines as disclosed in US EP0911693, hereby incorporated by reference, polymethine dyes, and other dyes capable of being bleached by the thermal-carbanion-generating agents of the invention. One preferred class of dyes is polymethine dyes. These are disclosed, for example, in W. S. Tuemmler and B. S. Wildi, *J. Amer. Chem. Soc.* 1958, 80, 3772; H. Lorenz and R. Wizinger, *Helv. Chem. Acta.* 1945, 28, 600; U.S. Pat. Nos. 2,813,802, 2,992,938, 3,099,630, 3,275,442, 3,436,353 and 4,547,444; and Japanese Patent No. 56109,358. The dyes have found utility in infrared screening compositions, as photochromic materials, as sensitizers for photoconductors, and as infrared absorbers for optical data storage media. Polymethine dyes have been shown to bleach in conventional photographic processing solutions, as disclosed in European Patent Publication No. EP 0,377,961, but have not previously been known to bleach by thermal-carbanion-generating processes.

One preferred class of dyes are barbituric acid arylidene dyes that undergo efficient thermal bleaching in the presence of base precursors in gelatin coatings. In one preferred embodiment, arylidene dyes can be represented by the following Structure (IV):

(IV)

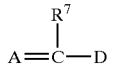

wherein A is derived from an acidic moiety, and D and $R^7$ are as defined below. The acidic moiety comprises a cyclic ketomethylene moiety. Examples of a cyclic ketomethylene moiety are barbituric acid and substituted or unsubstituted derivatives thereof. In a particularly preferred embodiment, the A group is represented by the following structure (V):

(V)

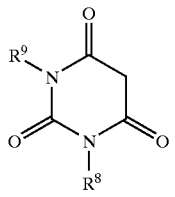

wherein $R^8$ and $R^9$ each individually represent a hydrogen, an alkyl group ("group" wherever used in the present application including the possibility of being substituted or unsubstituted alkyl) of 1 to 20 (preferably 1 to 8) carbon atoms; or an aryl, aralkyl, heterocyclic or cycloalkyl group of 5 to 14 carbon atoms.

The group $R^7$ in the above Structure IV represents hydrogen, an aryl group containing 6 to 14 carbon atoms, or an alkyl group containing 1 to 12 carbon atoms (which groups may be substituted). The group D in the above structure I may be an aryl or heteroaryl ring. The group D may preferably contains an atom with an available electron pair positioned in conjugation (with the carbonyl oxygen atoms of the barbituric acid ring when A represents a barbituric acid nucleus in Structure IV), said atom being an O, N, Se, S in a ring system or as a substituent on such a ring. D may particularly contain an O or N atom positioned in a ring in conjugation. By being positioned in "conjugation" with the carbonyl oxygen, it is meant that there is a conjugated system between the oxygen and the atom in D. Such systems are generally known in organic chemistry and refer to a chain in which a single bond, and a double or triple bond, appear alternately.

Some examples of preferred groups for D include:

(IVA)

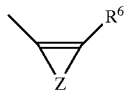

(IV B)

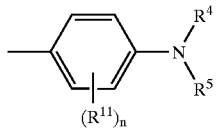

(IV C)

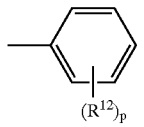

The groups $R^6$, $R^{11}$ and $R^{12}$ each individually represents a hydrogen, carboxy, carboxyalkyl, sulfonamido, sulfamoyl, or an alkyl, arylalkyl, cycloalkyl, alkoxy, alkylamino, or alkylthio group preferably of 1 to 10 carbon atoms. The groups $R^4$ and $R^5$ each individually represents an alkyl group, such as $CHR^{11}R^{12}$, preferably of 1 to 20 (and more preferably 1 to 8) carbon atoms or an alkenyl group preferably of 2 to 8 carbon atoms, or an aryl, arylalkyl, heterocyclic or cycloalkyl group preferably of 5 to about 14 carbon atoms. Alternatively, $R^4$ and $R^5$ together represent the non-metallic atoms required to form a substituted or unsubstituted 5- or 6-membered ring with each other, or $R^4$ and $R^5$ individually represent the non-metallic atoms necessary to form a substituted or unsubstituted 5- or 6-membered fused ring with the phenyl ring to which the nitrogen is attached. Preferred substituents, particularly on alkyl groups include carboxy, carboxyalkyl and sulfonamido.

The subscript "n" is 0, 1, 2, 3 or 4, preferably zero; the subscript "p" is 0, 1, 2, 3, 4 or 5, preferably 1 to 3.

The group Z individually represents the non-metallic atoms necessary to complete a substituted or unsubstituted ring system containing at least one 5- or 6-membered heterocyclic nucleus. For example, a ring system formed by Z may include pyridine, pyrazole, pyrrole, furan, thiophene, and congeners, or fused ring systems such as indole, benzoxazole, and congeners. The atoms represented by Z can also complete a 5- or 6-membered heterocyclic nucleus that can be fused with additional substituted or unsubstituted rings such as a benzo ring. Suitable heterocyclic nuclei are of the type commonly used in sensitizing dyes and are well known in the art. Many are described, for example, in James, *The Theory of the Photographic Process*, 4th Edition, pages 195–203. Useful heterocyclic nuclei include thiazole, selenazole, oxazole, imidazole, indole, benzothiazole, benzindole, naphthothiazole, naphthoxazole, benzimidazole, and the like. In a preferred embodiment, Z represents the atoms necessary to complete a substituted or unsubstituted benzoxazole or benzothiazole nucleus.

Examples of any of the alkyl groups mentioned above are methyl, ethyl, propyl, isopropyl, butyl, isobutyl, t-butyl, pentyl, hexyl, octyl, 2-ethylhexyl, and congeners. Cycloalkyl groups can be cyclopentyl, cyclohexyl, 4-methylcyclohexyl, and congeners. Alkenyl groups can be vinyl, 1-propenyl, 1-butenyl, 2-butenyl, and congeners. Aryl groups can be phenyl, naphthyl, styryl, and congeners. Arylalkyl groups can be benzyl, phenethyl, and congeners. Useful substituents on any of the foregoing or other groups disclosed, include halogen, alkoxy, acyl, alkoxycarbonyl, aminocarbonyl, carbonamido, carboxy, sulfamoyl, sulfonamido, sulfo, nitro, hydroxy, amino and congeners.

In a preferred embodiment, the compounds of Structure IV above are barbituric acid arylidene dyes represented by the following Structure IV:

(VI)

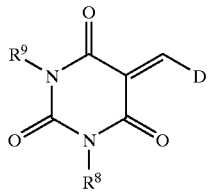

In a preferred embodiment, D is selected from the following groups:

(VI A)

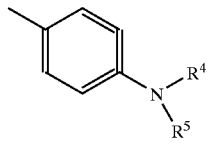

(VI B)

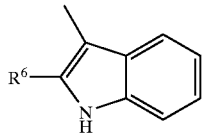

(VI C)

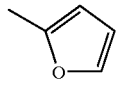

Structures of some exemplary barbituric acid arylidene dyes are as follows:

D-1

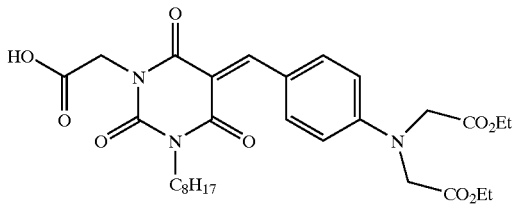

-continued

D-2

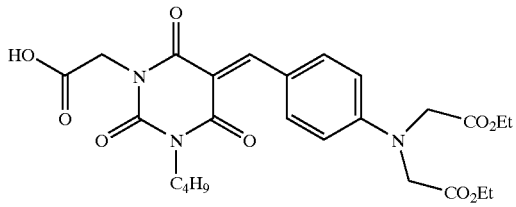

D-3

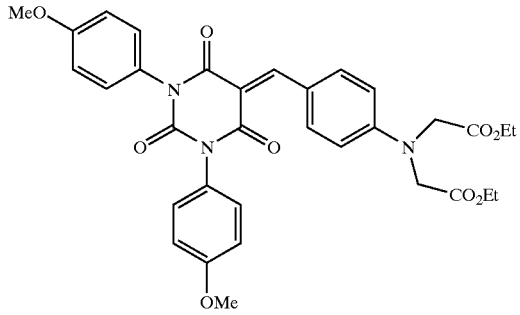

D-4

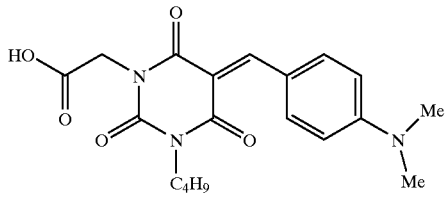

D-5

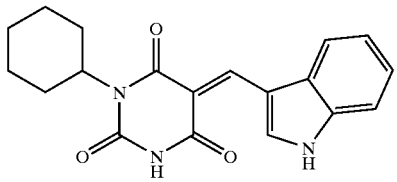

D-6

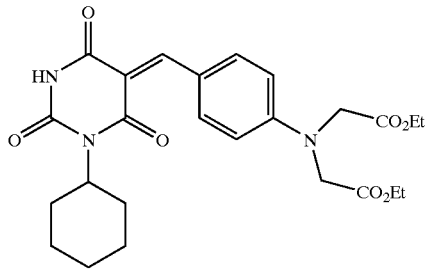

D-7

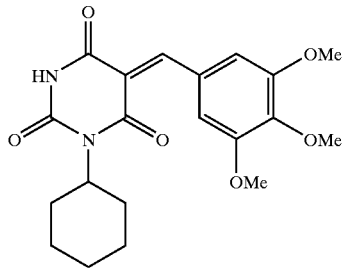

-continued

D-8

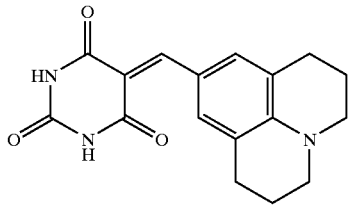

In a preferred embodiment, as indicated above, the above dyes are used as a yellow or magenta filter dye in a photothermographic element. The dyes such as D-1, D-2, D-3, D-4, D-5, D-6 and D-7 are suitable as yellow filter dyes. The dye D-8 is suitable as a magenta filter dye. The barbituric acid arylidene dyes undergo efficient thermal bleaching in the presence of base precursors of the present invention.

As indicated above, in principle, any dye capable of being bleached by the base precursors of the invention can be employed.

If desired, a combination of dye compounds can be used. Selection of the dye combinations will depend upon such factors as the processing conditions, desired degree of bleaching in the layer containing the dye or dyes, solubility characteristics of the components, spectral absorption characteristics, and the like. Combinations of different filter dyes can be used in the same layer or in different layers, depending on the purpose of the dye. Preferably, the filter dyes useful in a filter layer according to the present invention, if yellow, absorb mainly from about 400 to about 500 nm and will transmit most of the light in the range 500 to 850 nm. Preferably, a yellow filter dye will absorb mainly at from about 420 to about 480 nm and will transmit most of the light in the range 490 to 850 nm. Similarly, a magenta filter dye will absorb light mostly from 500 to 600 nm and preferably from 520 to 580 nm while transmitting most of the light shorter than 500 nm and longer than 600 nm.

The bleachable filter-dye compositions having the thermal base precursors described above should be changed by bleaching to the extent that at least about 40%, and preferably at least 50%, more preferably at least 60%, still more preferably at least 80%, and most preferably at least 90% of the layer absorption is changed from colored to colorless according to a standard test using Status M density. Thus, the filter layer, after bleaching, has minimal or substantially no optical density that will adversely affect the Dmin of the product during scanning, or during overall picture production using the photothermographic element.

Optional means for absorbing yellow, which may be additional to bleachable filter dyes, include Carey Lea silver or a yellow processing solution-decolorizable dye. Other suitable yellow filter dyes can be selected from among those illustrated by *Research Disclosure* I, Section VIIIB Absorbing materials.

Bleachable filter-dye compositions in accordance with the present invention have good incubation stability, allowing their incorporation into elements requiring prolonged storage. The dyes contained in the novel photothermographic elements of this invention are irreversibly bleached upon exposure to heat. The amount of heat required to cause bleaching of the layers is somewhat dependent upon the particular dye incorporated in the layer; higher temperatures require shorter times to bring about bleaching while lower temperatures require longer times. Generally, temperatures of at least 125° C. for a period of at least 5 seconds are required to bring about any noticeable bleaching. For photothermography, temperatures of 130° C. and above and times in excess of 10 seconds are generally preferred.

Depending on the choice of the filter dye, it can be in the filter layer in the form of solid particles, dissolved in a dispersed organic phase, emulsified, or dissolved in the aqueous matrix of the filter layer. Although dissolving a water-soluble dye in the aqueous matrix is easiest, it is not universally preferred since one would generally prefer that the dye remain in the layer in which it was coated.

The coverages and proportions of the components which comprise the described bleachable filter-dye compositions of the present invention can vary over wide ranges depending upon such factors as the particular use, location in the element of the filter component, the desired degree of absorption, processing temperatures, and the like. For example, in some photothermographic elements the concentration of dye is sufficient to provide a peak optical density of at least about 0.05. Particles of the filter dyes can be made by conventional dispersion techniques, such as milling, by preparing the particles by a limited coalescence procedure, or other procedures known in the art. Milling processes that can be used include, for example, processes described in U.K. Patent No. 1,570,632, and U.S. Pat. Nos. 3,676,147, 4,006,025, 4,474,872 and 4,948,718, the entire disclosures of which are incorporate herein by reference. Limited coalescence procedures that can be used include, for example, the procedures described in U.S. Pat. Nos. 4,994,3132, 5,055,371, 2,932,629, 2,394,530, 4,833,060, 4,834,084, 4,965,131 and 5,354,799, the entire disclosures of which are incorporated herein by reference. A suitable average size of the particles is 10 to 5000 nm, preferably 20 to 1000 nm, most preferably 30 to 500 nm.

In a preferred embodiment, the filter dye is dispersed in the binder in the form of a solid particle dispersion. Such dispersions can be formed by either milling the dye in solid form until the desired particle size range is reached, or by precipitating (from a solvent solution) the dye directly in the form of a solid particle dispersion. In the case of solid particle milling dispersal methods, a coarse aqueous premix, containing, for example, the barbituric acid arylidene compound and water, and optionally, any desired combination of water soluble surfactants and polymers, is made, and added to this premix prior to the milling operation. The resulting mixture is then loaded into a mill. The mill can be, for example, a ball mill, media mill, jet mill, attritor mill, vibratory mill, or the like. The mill is charged with the appropriate milling media such as, for example, beads of silica, silicon nitride, sand, zirconium oxide, yttria-stabilized zirconium oxide, alumina, titanium, glass, polystyrene, etc. The bead sizes typically range from 0.25 to 3.0 mm in diameter, but smaller media may be used if desired. Solid barbituric acid arylidene, for example, can be subjected to repeated collisions in slurry with the milling media, resulting in crystal fracture and consequent particle size reduction.

Surfactants and other additional conventional addenda may also be used in the dispersing process described herein in accordance with prior art solid particle dispersing procedures. Such surfactants, polymers and other addenda are disclosed in U.S. Pat. Nos. 5,468,598, 5,300,394, 5,278,037, 4,006,025, 4,924,916, 4,294,917, 4,940,654, 4,950,586, 4,927,744, 5,279,931, 5,158,863, 5,135,844, 5,091,296, 5,089,380, 5,103,640, 4,990,431, 4,970,139, 5,256,527, 5,015,564, 5,008,179, 4,957,857, and 2,870,012, British Patent specifications Nos. 1,570,362 and 1,131,179 referenced above, the disclosures of which are hereby incorporated by reference, in the dispersing process of the filter dyes.

In a preferred embodiment, the base precursor is also dispersed in the binder as a solid particle dispersion. All prior descriptions of dispersion milling techniques, formulations and procedures that have described the incorporation of the filter dye are also applicable to incorporation of the base precursor.

For aqueous imaging systems, the binders used in the aqueous dispersion or coating composition should be transparent or translucent and include those materials which do not adversely affect the reaction which changes the dye from colored to colorless and which can withstand the processing temperatures employed. These polymers include, for example, proteins such as gelatin, gelatin derivatives, cellulose derivatives, polysaccharides such as dextran and the like; and synthetic polymeric substances such as water soluble polyvinyl compounds like poly(vinyl alcohol), poly (vinyl pyrrolidone), acrylamide polymers and the like. Other useful synthetic polymeric compounds include dispersed vinyl compounds such as styrene butadiene rubbers in latex form. Effective polymers include high molecular weight materials, polymers and resins that are compatible with the imaging materials of the element. Combinations of the described colloids and polymers can also be useful if desired.

As indicated above, the base precursor as described can be useful in a variety of photothermographic elements. For example, such photothermographic elements are used in the field of microfilming, health imaging, graphic arts, consumer products, and the like. In the field of health or medical imaging, the originating exposure may be X-ray, for example, followed by the use of phosphorescent light for exposing the film. A preferred use of the present invention, however, is in consumer color photothermographic film that is to be scanned. It is especially convenient to scan such film without first removing the silver in the film, in which situation the bleaching of the dye will contribute to a low Dmin.

For black & white or monochromatic imaging elements, the phototographic elements are typically based on organic silver salt oxidizing agents and organic reducing agents as described in Owen U.S. Pat. No. 2,910,377, wherein are included silver behenate and silver stearate as well as the silver salts of a number of other organic acids, viz oleic, lauric, hydroxystearic, acetic, phthalic, terephthalic, butyric, m-nitrobenzoic, salicylic, phenylacetic, pyromellitic, p-phenylbenzoic, undecylenic, camphoric, furoic, acetamidobenzoic, and o-aminobenzoic. Other organic silver salts capable of providing similar effects include the silver salts of saccharin, benzotriazole, phthalazinone, 4'-n-octadecyloxydiphenyl-4-carboxylic acid, 10,12,14-octadecatrienoic acid, and benzoic acid. The silver salts of those organic acids that are water-insoluble and normally solid are preferred, since the byproducts do not adversely affect the coating.

Photographic layers containing the present compositions can also be used in color transfer processes that utilize the diffusion transfer of an imagewise distribution of developer, coupler or dye from a light-sensitive layer to a second layer while the two layers are in close proximity to one another. Color transfer processes of this type are described in Yutzy, U.S. Pat. No. 2,856,142; Land et al. U.S. Pat. No. 2,983,606; Whitmore et al. British Pat. Nos. 904,364 and 840,731; and Whitmore et al. U.S. Pat. No. 3,227,552.

A preferred embodiment of the invention is a photothermographic element comprising (a) a support having thereon (b) a photothermographic layer, and on the support or in the support (c) at least one thermal base precursor comprising the compound represented by the Structure (I), as described above, in association with a filter dye wherein the dye becomes at least about 50, preferably at least 70% colorless within about 30 seconds upon heating to a temperature of at least about 150° C., as determined by standard testing described herein. Preferably the support is suitably transparent for scanning purposes.

A visible image can be developed in a photothermographic element according to the invention within a short time after imagewise exposure merely by uniformly heating the photothermographic element to moderately elevated temperatures. For example, the photothermographic element can be heated, after imagewise exposure, to a temperature within the range that provides development of the latent image and also provides the necessary temperature to cause the filter layer to change from colored to colorless. Heating is typically carried out until a desired image is developed and until the filter layer is bleached to a desired degree. This heating time is typically a time within about 1 second to about 20 minutes, preferably about 1 second to about 90 seconds.

The described combination of a filter dye and base precursor can be in any suitable location in the photothermographic element which provides the desired bleaching of the dye upon heating. Typically, the inventive layer must be coated on the same side of the support as the radiation sensitive layers. In one embodiment of the invention, the dye is in association with a base precursor or base precursor to promote the desired heat bleaching in the filter component. The term "in association" as employed herein is intended to mean that the described materials are in a location with respect to each other that enables the desired processing and heat bleaching and provides a more useful developed image. The term is also employed herein to mean that the filter dye and the base precursor are in a location with respect to each other which enables the desired change of the dye from colored to colorless upon heating as described. In general, the two components should be in the same layer, meaning there is no significant barrier or distance between them even if not uniformly dispersed together. Preferably, however, the filter dye and the base precursor are uniformly interdispersed. Alternatively, however, a sufficient amount of base precursor may transfer from an adjacent imaging layer before and during thermal processing.

A simple exemplary photothermographic element, showing one embodiment comprising filter layers and their placement in the element, can be represented as follows:

| |
|---|
| UV Overcoat |
| Blue Sensitive Layer |
| Yellow Filter Layer |
| Green Sensitive Layer |
| Magenta Filter Layer |
| Red Sensitive Layer |
| antihalation Layer |
| Support |

As indicated above, the invention is especially useful in a dry photothermographic process (or "dry thermal process"). By a "dry thermal process" is meant herein a process involving, after imagewise exposure of the photographic element, development of the resulting latent image by the use of heat to raise the temperature of the photothermographic element or film to a temperature of at least about 80° C., preferably at least about 100° C., more preferably at about 120° C. to 180° C., in a dry process or an apparently dry process. By a "dry process" is meant without the external application of any aqueous solutions. By an "apparently dry process" is meant a process that, while involving the external application of at least some aqueous solutions, does not involve an amount more than the uniform saturation of the film with aqueous solution.

This dry thermal process typically involves heating the photothermographic element until a developed image is formed, such as within about 0.5 to about 60 seconds. By increasing or decreasing the thermal processing temperature a shorter or longer time of processing is useful. Heating means known in the photothermographic arts are useful for providing the desired processing temperature for the exposed photothermographic element. The heating means can, for example, be a simple hot plate, iron, roller, heated drum, microwave heater, heated air, vapor or the like. Thermal processing is preferably carried out under ambient conditions of pressure and humidity, for simplicity sake, although conditions outside of normal atmospheric pressure and humidity are also useful.

A dry thermal process for the development of a color photothermographic film for general use with respect to consumer cameras provides significant advantages in processing ease and convenience, since they are developed by the application of heat without wet processing solutions. Such film is especially amenable to development at kiosks or at home, with the use of essentially dry equipment. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

Preferably, during thermal development an internally located blocked developing agent, in reactive association with each of three light-sensitive units, becomes unblocked to form a developing agent, whereby the unblocked developing agent is imagewise oxidized on development. It is necessary that the components of the photographic combination be "in association" with each other in order to produce the desired image. The term "in association" herein means that in the photothermographic element, the photographic silver halide and the image-forming combination are in a location with respect to each other that enables the desired processing and forms a useful image. This may include the location of components in different layers.

A typical color photothermographic element will now be described. The support for the photothermographic element can be either reflective or transparent, which is usually preferred. When reflective, the support is white and can take the form of any conventional support currently employed in color print elements. When the support is transparent, it can be colorless or tinted and can take the form of any conventional support currently employed in color negative elements-e.g., a colorless or tinted transparent film support. Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such subbing layers and the like. Transparent and reflective support constructions, including subbing layers to enhance adhesion, are disclosed in Section XV of *Research Disclosure* I.

The filter dyes of the present invention can be used in the antihalation layer, the yellow filter layer, or the magenta filter layer in the above photothermographic element. In such an embodiment, the photosensitive layers are coated from aqueous melts on a transparent support with a (thermally bleachable) AHU (antihalation undercoat), an overcoat containing UV protection, a (thermally-bleachable) yellow filter layer between the blue-sensitized and green-sensitized records, and the magenta filter dye layer between the green-sensitized and red-sensitized layers. The magenta filter layer is typically under the green record and provides substantially no red absorption. This magenta filter layer is a non-light-sensitive interlayer located further from the support than any red-sensitized layer, and closer to the support than any green-sensitized layer. Similarly, a yellow filter layer is typically under the blue record and provides substantially no green absorption. This yellow filter layer is a non-light-sensitive interlayer located further from the support than any green-sensitized layer, and closer to the support than any blue-sensitized layer.

Photographic elements may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

In an example (one embodiment) of a color negative film construction, each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion-containing layer, the coupler containing hydrophilic colloid layer is positioned to receive oxidized color developing agent from the emulsion during development. Usually the coupler-containing layer is the next adjacent hydrophilic colloid layer to the emulsion containing layer.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by *Research Disclosure* I, cited above, X. Dye image formers and modifiers, B. Image-dye-forming couplers. The photographic elements may further contain other image-modifying compounds such as "Development Inhibitor-Releasing" compounds (DIR's) known in the art. DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the photothermographic element is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptances according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The photothermographic element may have interlayers that are hydrophilic colloid layers having as their primary function color contamination reduction-i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate a reducing agent capable of reacting with oxidized developing agent. Antistain agents (oxidized developing agent scavengers) can be selected from among those disclosed by *Research Disclosure* I, X. Dye image formers and modifiers, D. Hue modifiers/stabilization, paragraph (2).

The yellow filter dye compositions, for use in IL1, of the present invention are particularly useful when one or more silver halide emulsions in GU and RU are high bromide emulsions and, hence have significant native sensitivity to blue light.

Alternative layer unit sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

The photothermographic elements of the present invention are preferably of type B as disclosed in *Research Disclosure* I. Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds. Especially in the case of black and white or monochromic photothermographic films, preferred examples thereof include compounds having a carboxyl group, for example, a silver salt of an aliphatic carboxylic acid or a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc.

Preferred examples of organic silver donors for color photothermography include silver salts of benzotriazole and derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

Any convenient selection from among conventional radiation-sensitive silver halide emulsions can be incorporated within the layer units and used to provide the spectral absorptances of the invention. The grains can be either regular or irregular (e.g., tabular). Illustrations of conventional radiation-sensitive silver halide emulsions are provided by *Research Disclosure* I, cited above, I. Emulsion grains and their preparation. Chemical sensitization of the emulsions, which can take any conventional form, is illustrated in section IV. Chemical sensitization. The emulsion layers also typically include one or more antifoggants or stabilizers, which can take any conventional form, as illustrated by section VII. Antifoggants and stabilizers.

Because in one embodiment of the invention only silver development is required, color developers (p-phenylene diamines or p-aminophenolics) are not obligatory. Other developers that are capable of forming a silver image may also be used, without regard to their ability to form a colored dye. Such developers include, in addition to p-phenylene diamine developers and substituted p-aminophenols (3,5-dichloroaminophenol and 3,5-dibromoaminophenol are particularly preferred choices) but also p-sulfonamidophenols, ascorbic acid, low valent metal compounds, particularly those containing Fe(II), Cu(I), Co(II), Mn(II), V(II), or Ti(III), hydrazine derivatives, hydroxylamine derivatives, phenidones. For incorporated developers, thermally unblocking blocked developers are preferred.

In some cases, a development activator, also known as an alkali-release agent, base-release agent or an activator precursor can be useful in the described photothermographic element of the invention. A development activator, as described herein, is intended to mean an agent or a compound which aids the developing agent at processing temperatures to develop a latent image in the imaging material. Useful development activators or activator precursors are described, for example, in Belgian Pat. No. 709, 967 published Feb. 29, 1968, and Research Disclosure, Volume 155, March 1977, Item 15567, published by Industrial Opportunities Ltd., Homewell, Havant, Hampshire, PO9 1EF, UK. Examples of useful activator precursors include guanidinium compounds such as guanidinium trichloroacetate, diguanidinium glutarate, succinate, malonate and the like; quaternary ammonium malonates; amino acids, such as 6-aminocaproic acid and glycine; and 2-carboxycarboxamide activator precursors.

Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR PHOTOTHERMOGRAPHIC ELEMENT CONTAINING A BLOCKED PHOTOGRAPHICALLY USEFUL COMPOUND.

In one embodiment of the invention, the blocked developer is preferably incorporated in one or more of the imaging layers of the imaging element. The amount of blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. The blocked developer can be contained in a separate element that is contacted to the photographic element during processing.

After image-wise exposure of the imaging element, the blocked developer can be activated during processing of the imaging element by the presence of acid or base in the processing solution, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxylamine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

It is useful to include a melt-forming compound in a photothermographic element, such as in the imaging layers and in the antihalation layer or filter layer, as described. Combinations of melt-forming compounds or melt-formers can also be useful if desired. The term "melt-forming compound" as employed herein is intended to mean a compound that upon heating to the described processing temperature provides an improved reaction medium, typically a molten medium, wherein the described reaction combination can provide a better image. The exact nature of the reaction medium at processing temperatures described is not fully understood; however, it is believed that at reaction temperatures a melt occurs that permits the reaction components to better interact. Useful melt-forming compounds are typically separate components from the reaction combination, although the reaction combination can enter into the melt formation. Typically useful melt-forming compounds are amides, imides, cyclic ureas and triazoles that are compatible with other of the components of the materials of the invention. Useful melt-forming compounds are described, for example, in Research Disclosure, Vol. 150, October 1976, Item 15049 of LaRossa and Boettcher, published by Industrial Opportunities Ltd., Homewell, Havant, Hampshire, PO9 1EF, UK. As described, the filter layers of the invention can comprise a melt-forming compound if desired. Preferred melt-formers include salicylanilide and similar compounds.

A range of concentration of melt-forming compound or melt-forming compound combination is useful in the heat developable photographic materials described. The optimum concentration of melt-forming compound will depend upon such factors as the particular imaging material, desired image, processing conditions and the like.

Photothermographic elements as described can contain addenda that are known to aid in formation of a useful image. The photothermographic element can contain development modifiers that function as speed increasing compounds, sensitizing dyes, hardeners, anti-static agents, plasticizers and lubricants, coating aids, brighteners, such as described in *Research Disclosure*, December 1978, Item No. 17643 and *Research Disclosure*, June 1978, Item No. 17029.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

Once yellow, magenta, and cyan dye image records, or other combination of three distinct colors, have been formed in the processed photographic elements of the invention, conventional techniques can be employed for retrieving the image information for each color record and manipulating the record for subsequent creation of a color balanced viewable image. For example, it is possible to scan the photographic element successively within the three distinct color regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor that converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with calorimetric or tonal information to form an electronic record that is suitable to allow reconstruction of the image into viewable forms such as computer monitor displayed images, television images, printed images, and so forth.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443. Methods for the scanning of such films are also disclosed in commonly assigned U.S. Ser. No. 60/211,364 and U.S. Ser. No. 60/211,061, hereby incorporated by reference in their entirety.

For example, it is possible to scan the photographic element successively within the blue, green, and red regions of the spectrum or to incorporate blue, green, and red light within a single scanning beam that is divided and passed through blue, green, and red filters to form separate scanning beams for each color record. If other colors are imagewise present in the element, then appropriately colored light beams are employed. A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in U.S. Ser. No. 09/592,816 titled AN IMAGE PROCESSING AND MANIPULATION SYSTEM to Richard P. Szajewski, Alan Sowinski and John Buhr.

For illustrative purposes, a non-exhaustive list of photothermographic film processes involving a common dry heat development step is as follows:

1. heat development=>scan=>stabilize (for example, with a laminate)=>scan=>obtain returnable archival film.

2. heat development=>fix bath=>water wash=>dry=>scan=>obtain returnable archival film 3. heat development=>scan=>blix bath=>dry=>scan=>recycle all or part of the silver in film 4. heat development=>bleach laminate=>fix laminate=>scan=>(recycle all or part of the silver in film)

5. heat development=>bleach=>wash=>fix=>wash=>dry=>relatively slow, high quality scan In a preferred embodiment of a photothermographic film according to the present invention, the processing time to first image (either hard or soft display for customer/consumer viewing), including (i) thermal development of a film, (ii) scanning, and (iii) the formation of the positive image from the developed film, is suitably less than 5 minutes, preferably less than 3.5 minutes, more preferably less than 2 minutes, most preferably less than about 1 minute. In one embodiment, such film might be amenable to development at kiosks, with the use of simple dry or apparently dry equipment. Thus, it is envisioned that a consumer could bring an imagewise exposed photographic film, for development and printing, to a kiosk located at any one of a number of diverse locations, optionally independent from a wet-development lab, where the film could be developed and printed without any manipulation by third-party technicians. A photothermographic color film, in which a silver-halide-containing color photographic element after imagewise exposure can be developed merely by the external application of heat and/or relatively small amounts of alkaline or acidic water, but which same film is also amenable to development in an automated kiosk, preferably not requiring third-party manipulation, would have significant advantages. Assuming the availability and accessibility of such kiosks, such photothermographic films could potentially be developed at any time of day, "on demand," in a matter minutes, without requiring the participation of third-party processors, multiple-tank equipment and the like. Optional, such photographic processing could potentially be done on an "as needed" basis, even one roll at a time, without necessitating the high-volume processing that would justify, in a commercial setting, equipment capable of high-throughput. Color development and subsequent scanning of such a film could readily occur on an individual consumer basis, with the option of generating a display element corresponding to the developed color image. By kiosk is meant an automated free-standing machine, self-contained and (in exchange for certain payments) capable of developing a roll of imagewise exposed film on a roll-by-roll basis, without the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably 3 cubic meters or less in dimension, and hence commercially transportable to diverse locations. Such kiosks may optionally comprise a heater for color development, a scanner for digitally recording the color image, and a device for transferring the color image to a display element.

The following examples are presented to illustrate the practice of this invention, but are not meant to limit it in any way. All percentages are by weight unless otherwise indicated.

EXAMPLES

The arylsulfonylacetic acid portion of BP-1 base precursor was prepared, starting with the commercially available 4-carboxyphenyl disulfide 1, as follows:

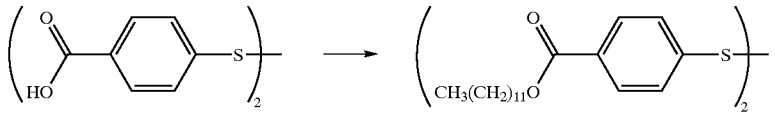

1 2

-continued

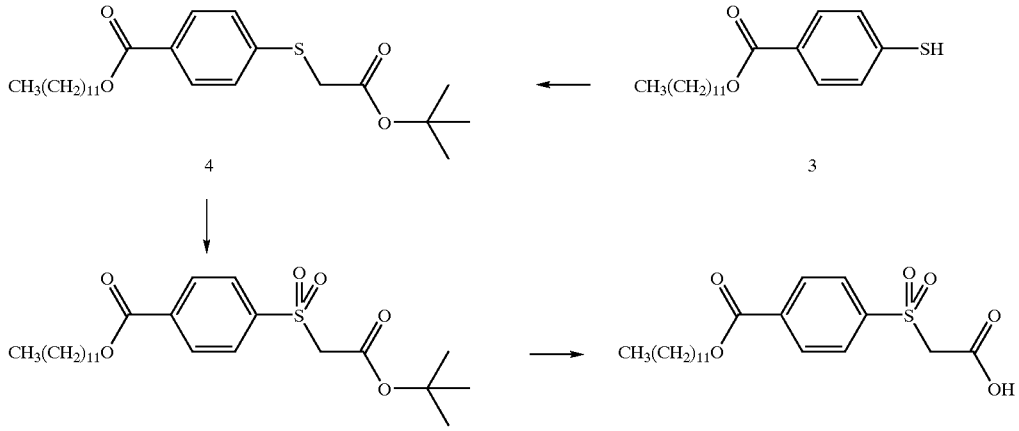

Preparation of Intermediate 2.

A solution of the disulfide 1 (22.00 g, 71.8 mmol), 1-bromododecane (39.38 g, 158 mmol), and triethylamine (15.99 g, 158 mmol) in N,N-dimethylformamide (200 mL) was stirred at 70–75° C. for 20 h. The mixture was then poured into water (1200 mL)/conc. Hydrochloric acid (100 mL), stirred for 18 h, and filtered to collect the crude product.

Recrystallization from ethanol produced 2 (32.41 g, 50.4 mmol, 70%).

Preparation of Intermediate 3.

Intermediate 2 (25.72 g, 40 mmol) was suspended in a solution of triphenylphosphine (10.94 g, 41.7 mmol) and 5% aqueous hydrochloric acid (2 mL) in 1,4-dioxane (200 mL). Stirring at room temperature in a stoppered flask for 2 h produced a solution of the product 3 and triphenylphosphine oxide. The reaction was worked up with ether and brine giving a solid from which 3 was extracted with hexanes at room temperature. The yield of 3 was 26.58 g (82.4 mmol, 103%).

Preparation of Intermediate 4.

A solution of t-butyl bromoacetate (15.31 g, 78.5 mmol) in acetonitrile (80 mL) was added in drops over a period of ½ h to a mixture of 3 (26.58 g, 82.4 mmol) and potassium carbonate (11.94 g, 86.4 mmol) in acetonitrile (80 mL) that was stirred in an ice bath. Following the addition, the reaction mixture was stirred at room temperature for 18 h, filtered and the filtrate taken to dryness to give 33.56 g (76.9 mmol, 98%) of 4.

Preparation of Intermediate 5.

A solution of m-chloroperbenzoic acid (ca. 77%, 46.19 g, 206.1 mmol) in dichloromethane (450 mL) was added in drops over a period of 1 h 10 min to a solution of 4 (29.99 g, 68.7 mmol) in dichloromethane (225 mL) that was stirred in an ice bath. After the addition the mixture was stirred at room temperature for 18 h and then quenched with 310 mL of saturated aqueous sodium bicarbonate. The organic layer was dried (sodium sulfate) and the solvent distilled off leaving a solid. Purification by column chromatography gave 29.40 g of 5 (62.7 mmol, 91%).

Preparation of Intermediate 6.

Trifluoroacetic acid (48 mL) was added to a solution of 5 (31.60 g, 67.4 mmol) in dichloromethane (250 mL) and the mixture was stirred at room temperature for 3 days. The solvents were distilled off giving 6 as a white solid (24.68 g, 59.8 mmol, 89%).

The base precursors of the present invention were prepared using the general procedures described in EP708086 A1 and U.S. Pat. No. 4,981,965.

Photographic Example

A photothermographic element comprising base precursor according to the present invention was prepared, using the following components for comparison to a prior base precursor.

Blocked Developer BD-1 Dispersion:

The check dispersion was prepared by combining 3 g of BD-1 with 3 g of a 10% Olin 10G aqueous solution, 9 g of high purity water and 15 ml of 0.7 mm zirconium silicate beads. The mixture was milled for 90 minutes in a high-energy media mill. After milling, the dispersion was separated from the beads and diluted to 15% developer with high purity water. The dispersion was examined by optical microscopy immediately after milling, and after being held for 24 hours at 45° C.

Base Precursor Dispersions:

The base precursor dispersions were prepared by the method of ball milling. The dispersion of the base precursor BP-1 and the comparison base precursor CB-1, in accordance with the present invention, was prepared following the procedures below:

CB-1 Dispersion

The following ingredients were combined in a 32-oz glass jar: 6.72 g of base precursor, 10.08 g of a 10% solution of the DAPRYL polymeric surfactant, 175.2 g of high purity water, and 475 mL of 1.8 mm zirconium oxide ceramic beads. The jar was sealed and rolled at 65 ft/min for 3 days. Following milling, the zirconium oxide beads were removed by filtration without dilution.

BP-1 Dispersion:

The following ingredients were combined in a 32-oz glass jar: 7.35 g of base precursor, 11.03 g of a 10% solution of the DAPRYL polymeric surfactant, 191.6 g of high purity water, and 519 mL of 1.8 mm zirconium oxide ceramic beads. The jar was sealed and rolled at 65 ft/min for 3 days. Following milling, the zirconium oxide beads were removed by filtration without dilution.

The following photothermographic multilayer format was used for evaluation of the base precursors in this invention. As shown in Table 1, the formula contains a bleachable yellow filter dye, BYFD-1, in the yellow filter record.

TABLE 1

| | |
|---|---|
| Overcoat | 1.291 g/m$^2$ Gelatin |
| | 0.039 g/m$^2$ Silicone Lubricant |
| | 0.018 g/m$^2$ Matte Beads |
| | 0.097 g/m$^2$ UV-1 |
| | 0.586 g/m$^2$ AS-1 |
| Fast Yellow | 2.582 g/m$^2$ Gelatin |
| | 0.151 g/m$^2$ Ag-BZT |
| | 0.151 g/m$^2$ Ag-PMT |
| | 0.323 g/m$^2$ Coupler Y-1 |
| | 0.032 g/m$^2$ Addenda A-1 |
| | 0.699 g/m$^2$ Salicylanilide |
| | 0.699 g/m$^2$ Developer BD-1 |
| | 0.646 g/m$^2$ Emulsion Y-1 |
| Slow Yellow | 2.744 g/m$^2$ Gelatin |
| | 0.237 g/m$^2$ Ag-BZT |
| | 0.237 g/m$^2$ Ag-PMT |
| | 0.516 g/m$^2$ Coupler Y-1 |
| | 0.032 g/m$^2$ Addenda A-1 |
| | 0.463 g/m$^2$ Salicylanilide |
| | 0.581 g/m$^2$ Developer BD-1 |
| | 0.215 g/m$^2$ Emulsion Y-2 |
| | 0.075 g/m$^2$ Emulsion Y-3 |
| | 0.301 g/m$^2$ Emulsion Y-4 |
| | 0.377 g/m$^2$ Emulsion Y-5 |
| Yellow Filter | 1.076 g/m$^2$ Gelatin |
| | 0.002 g/m$^2$ Doctor D-1 |
| | 0.269 g/m$^2$ Salicylanilide |
| | 0.269 g/m$^2$ Bleachable Yellow Filter Dye BYFD-1 Base Precursor |
| Fast Magenta | 2.001 g/m2 Gelatin |
| | 0.151 g/m$^2$ Ag-BZT |
| | 0.151 g/m$^2$ Ag-PMT |
| | 0.323 g/m$^2$ Coupler M-1 |
| | 0.022 g/m$^2$ Addenda A-1 |
| | 0.283 g/m$^2$ Salicylanilide |
| | 0.355 g/m$^2$ Developer BD-1 |
| | 0.646 g/m$^2$ Emulsion M-1 |
| Mid Magenta | 1.044 g/m$^2$ Gelatin |
| | 0.118 g/m$^2$ Ag-BZT |
| | 0.118 g/m$^2$ Ag-PMT |
| | 0.183 g/m$^2$ Coupler M-1 |
| | 0.022 g/m$^2$ Addenda A-1 |
| | 0.118 g/m$^2$ Salicylanilide |
| | 0.118 g/m$^2$ Developer BD-1 |
| | 0.065 g/m$^2$ Emulsion M-2 |
| | 0.172 g/m$^2$ Emulsion M-3 |
| Slow Magenta | 1.022 g/m$^2$ Gelatin |
| | 0.118 g/m$^2$ Ag-BZT |
| | 0.118 g/m$^2$ Ag-PMT |
| | 0.183 g/m$^2$ Coupler M-1 |
| | 0.022 g/m$^2$ Addenda A-1 |
| | 0.086 g/m$^2$ Salicylanilide |
| | 0.118 g/m$^2$ Developer BD-1 |
| | 0.247 g/m$^2$ Emulsion M-4 |
| Magenta Filter | 1.076 g/m$^2$ Gelatin |
| | 0.002 g/m$^2$ Doctor D-1 |
| | 0.269 g/m$^2$ Salicylanilide |
| | 0.043 g/m$^2$ Filter Dye MFD-1 |
| Fast Cyan | 2.044 g/m$^2$ Gelatin |
| | 0.151 g/m$^2$ Ag-BZT |
| | 0.151 g/m$^2$ Ag-PMT |
| | 0.258 g/m$^2$ Coupler M-1 |
| | 0.022 g/m$^2$ Addenda A-1 |
| | 0.334 g/m$^2$ Salicylanilide |
| | 0.473 g/m$^2$ Developer BD-1 |
| | 0.646 g/m$^2$ Emulsion C-1 |
| Mid Cyan | 1.399 g/m$^2$ Gelatin |
| | 0.118 g/m$^2$ Ag-BZT |
| | 0.118 g/m$^2$ Ag-PMT |
| | 0.231 g/m$^2$ Coupler M-1 |
| | 0.022 g/m$^2$ Addenda A-1 |
| | 0.237 g/m$^2$ Salicylanilide |

TABLE 1-continued

| | |
|---|---|
| | 0.237 g/m$^2$ Developer BD-1 |
| | 0.151 g/m$^2$ Emulsion C-2 |
| | 0.151 g/m$^2$ Emulsion C-3 |
| Slow Cyan | 1.399 g/m$^2$ Gelatin |
| | 0.118 g/m$^2$ Ag-BZT |
| | 0.118 g/m$^2$ Ag-PMT |
| | 0.231 g/m$^2$ Coupler M-1 |
| | 0.022 g/m$^2$ Addenda A-1 |
| | 0.237 g/m$^2$ Salicylanilide |
| | 0.237 g/m$^2$ Developer BD-1 |
| | 0.301 g/m$^2$ Emulsion C-4 |
| Antihalation Layer | 2.077 g/m$^2$ Gelatin |
| | 0.008 g/m$^2$ Doctor D-2 |
| | 0.269 g/m$^2$ Doctor D-3 |
| | 0.001 g/m$^2$ Doctor D-4 |
| | 0.001 g/m$^2$ Doctor D-5 |
| | 0.002 g/m$^2$ Doctor D-1 |
| | 0.140 g/m$^2$ Antihalation Dye AHU-1 |

UV-1:

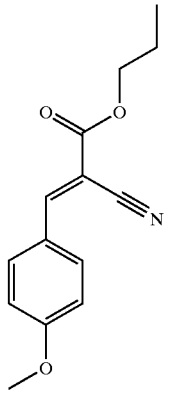

AS-1: FC-135 Fluorad® Fluorinated Surfactant (3M Corp.)

Ag-PMT: Silver salt of phenylmercaptotetrazole

Ag-BZT: Silver salt of benzotriazole.

Coupler Y-1:

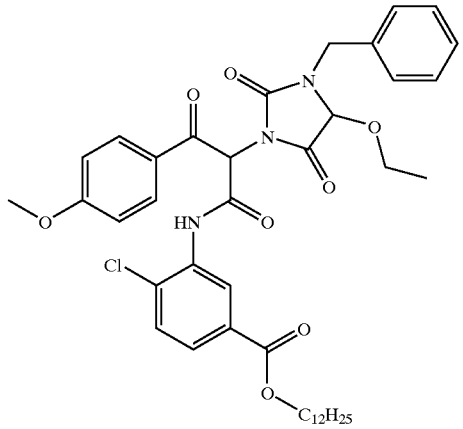

Addenda A-1:
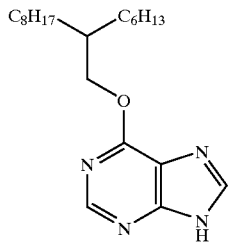
Developer BD-1:
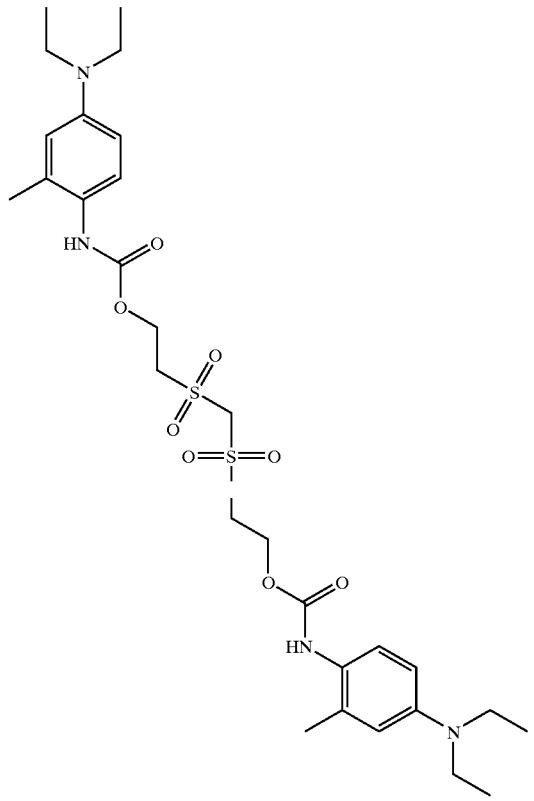
Coupler M-1:
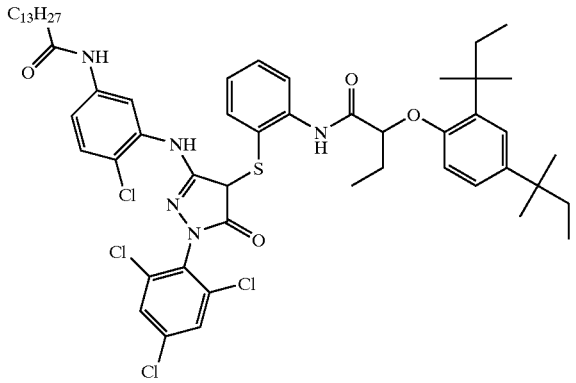
Coupler C-1:
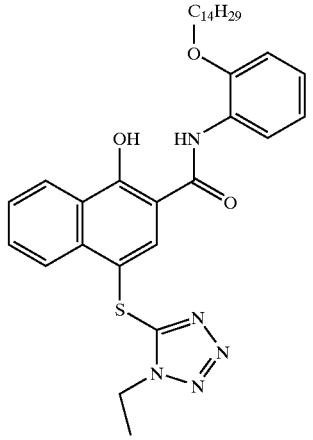
MFD-1:
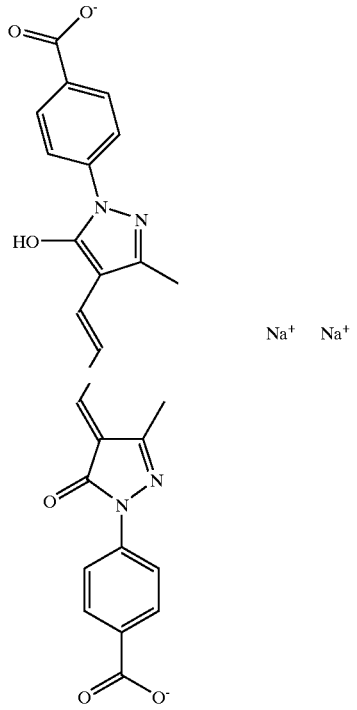

BYFD-1:

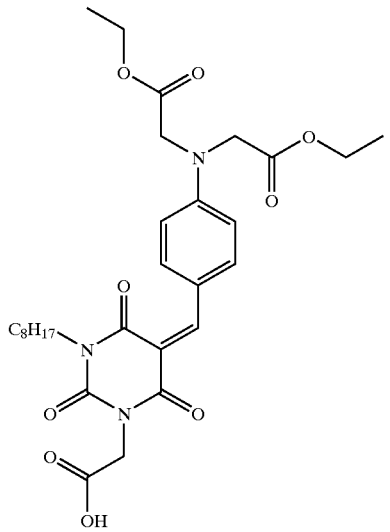

Antihalation Dye AHU-1:

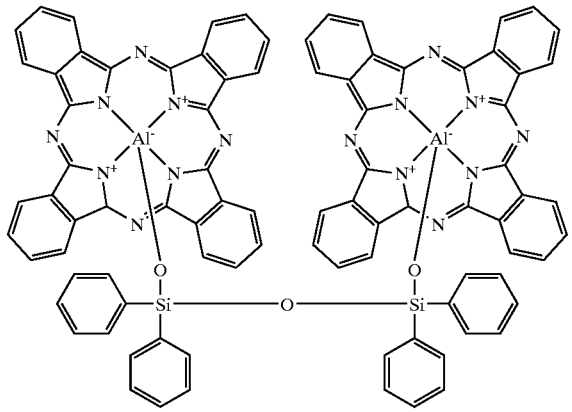

Doctor D-1: Tetrachlorodiammonium palladate

Doctor D-2: Sodium hexametaphosphate

Doctor D-3:

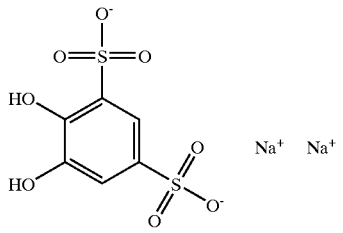

Doctor D-4:

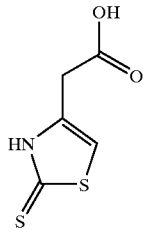

Doctor D-5: Manganese Sulfate

Emulsions:

Y-1: 2.11×0.12 micron blue sensitive

Y-2: 1.39×0.119 micron blue sensitive

Y-3: 0.61×0.138 micron blue sensitive

Y-4: 0.50×0.128 micron blue sensitive

M-1: 2.1×0.121 micron green sensitive

M-2: 1.37×0.119 micron green sensitive

M-3: 0.61×0.138 micron green sensitive

M-4: 0.50×0.128 micron green sensitive

C-1: 2×0.12 micron red sensitive

C-2: 1.36×0.121 micron red sensitive

C-3: 0.61×0.138 micron red sensitive

C-4: 0.50×0.128 micron red sensitive

Comparison coating C-1 was formulated as shown above with 0.753 g/$m_2$ of comparison base precursor CB-1 in the yellow filter layer. Inventive coating I-1 was formulated with 0.753 g/$m_2$ of the inventive base precursor BP-1 in the yellow filter layer.

Base Precursor CB-1

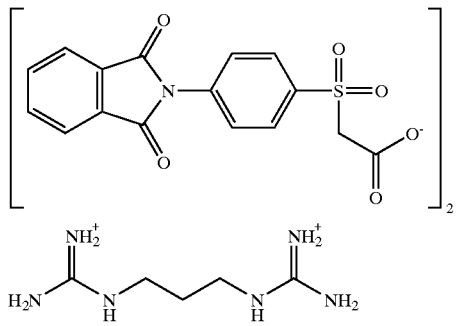

Base Precursor BP-1

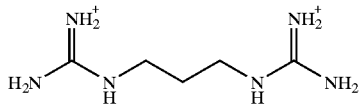

-continued

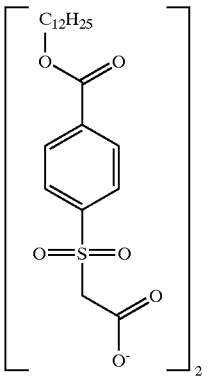

Sensitometric testing was accomplished by exposing strips of film to a 3.4 log lux light source (filtered to simulate 5500K) through a step wedge for 0.01 seconds. The film was then processed on a heated drum for 18 seconds at 157.5° C., and then subjected to standard C-41 bleach and fix processing prior to making densitometric measurements. Sensitometry was measured for fresh samples and for samples that had received prior to exposure a treatment to simulate consumer handling. This treatment consisted of maintaining the coatings in an environment of 50% relative humidity and 120° F. for 1 week.

In addition to the above sensitometric characterization, the effectiveness of dye bleaching was determined by examining the optical density of the films at 450 nm both before and after the thermal processing.

Table 2 shows the results of the performance of coating C-1 and I-1 for the fresh sensitometric parameters:

TABLE 2

| | Dmin | | | Dmax | | |
|---|---|---|---|---|---|---|
| Coating | R | G | B | R | G | B |
| C-1 | 0.84 | 0.50 | 0.48 | 1.87 | 2.49 | 1.81 |
| I-1 | 0.78 | 0.46 | 0.42 | 1.73 | 2.56 | 1.81 |

It can be seen from Table 2 that BP-1 provides improved Dmin performance while in general maintaining the image forming capability of the coating as indicated by the maximum density formed, Dmax.

Coatings C-1 and I-1 were treated to simulate consumer handling as described above. Typically the above treatment will lead to some speed loss and it is desirable to minimize such loss. Table 3 shows the speed loss upon consumer handling simulation for all three color records. The speed is measured at a point 0.15 density units above Dmin. The data in Table 3 below show that speed loss is minimized by use of the inventive base precursor BP-1.

TABLE 3

| | Speed Loss (log(E)) | | |
|---|---|---|---|
| Coating | Red | Green | Blue |
| C-1 | 0.28 | 0.28 | 0.19 |
| I-1 | 0.15 | 0.20 | 0.09 |

Table 4 below compares the densities of coatings C-1 and I-1 before and after thermal processing.

TABLE 4

| Coating | Raw Stock Density @ 450 nm | Processed Density @ 450 nm |
|---|---|---|
| C-1 | 1.92 | 1.54 |
| I-1 | 1.92 | 1.36 |

The results in Table 4 demonstrate that the inventive base precursor has the capability to provide equal density in the unprocessed material and more efficient thermal bleaching.

The invention has been described in detail with particular reference to certain preferred embodiments thereof, but it will be understood that variations and modifications can be effected within the spirit and scope of the invention.

What is claimed is:

1. A composition comprising a base precursor that is the salt of an organic base with an arylsulfonylacetic acid having the following structure:

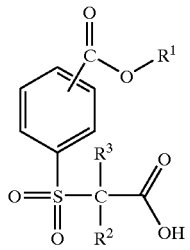

wherein the group $R^1$ represents a substituted or unsubstituted alkyl group, cycloalkyl group, aralkyl group, aryl group or heterocyclic group;

each of $R^2$ and $R^3$ is independently a monovalent group;

said base precursor being further in association with a filter dye;

wherein the organic base is a diacidic to tetraacidic base having the following Structure;

$$R^{13}(—B)_n$$

wherein $R_{13}$ is an n-valent residue of a hydrocarbon or heterocyclic ring, each of which may have one or more substituent groups; "n" is an integer of 2 to 4;

and wherein "B" is a monovalent group corresponding to an atomic group formed by removing one hydrogen atom from an guanidine having the Structure;

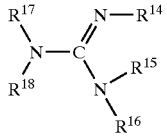

wherein each of $R^{14}$, $R^{15}$, $R^{16}$, $R^{17}$ and $R^{18}$ are independently a hydrogen, an alkyl group, an alkenyl group, an alkynyl group, a cycloalkyl group, an aralkyl group, an aryl group and a heterocyclic group, wherein each of $R^{14}$, $R^{15}$, $R^{16}$, $R^{17}$ and $R^{18}$ may have one or more substituent groups; or any two of $R^{14}$, $R^{15}$, $R^{16}$, $R^{17}$ and $R^{18}$ may by combined together to form a five-membered or six-membered nitrogen containing heterocyclic ring;

wherein base precursor is capable of bleaching the filter dye, thereby forming a composition that is useful as a thermally bleachable dye composition, wherein said arylsulfonylacetic acid undergoes decarboxylation at a temperature of 50 to 200° C. and will form a carbanion that is capable of abstracting a hydrogen from the organic base, rendering the organic base effective as a bleaching agent for said dye.

2. The composition of claim 1 wherein said monovalent group in the arylsulfonylacetic acid is selected from the group consisting of hydrogen, an alkyl group, an alkenyl group, a cycloalkyl group, an aralkyl group, an aryl group and a heterocyclic group, wherein each of the monovalent groups may have one or more substituent groups.

3. The composition of claim 1 wherein the filter dye is blocked, and the base precursor is capable of promoting the unblocking of the filter dye.

4. The composition of claim 1 wherein each of $R^2$ and $R^3$ is independently hydrogen, an alkyl group and an aryl group.

5. The composition of claim 1 wherein both $R^2$ and $R^3$ represent hydrogen.

6. The composition of claim 2 wherein each of the alkyl groups has 1 to 8 carbon atoms.

7. A photothermographic element comprising a support having thereon at least one light-sensitive imaging layer and at least one layer comprising an effective amount of a base precursor comprising the salt of an organic base with an arylsulfonylacetic acid having the following structure:

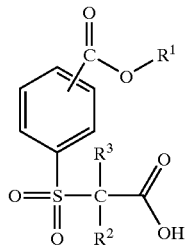

wherein the group $R^1$ represents a substituted or unsubstituted alkyl group cycloalkyl group, aralkyl group, aryl group or heterocyclic group;

each of $R^2$ and $R^3$ is independently a monovalent group;

said base precursor being further in bleaching association with a filter dye;

wherein the organic base is a diacidic to tetraacidic base having the following Structure;

$$R^{13}(—B)_n$$

wherein $R_{13}$ is an n-valent residue of a hydrocarbon or heterocyclic ring, each of which may have one or more substituent groups; "n" is an integer of 2 to 4;

and wherein "B" is a monovalent group corresponding to an atomic group formed by removing one hydrogen atom from an guanidine having the Structure;

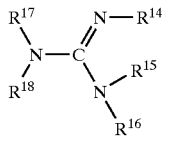

wherein each of $R^{14}$, $R^{15}$, $R^{16}$, $R^{17}$ and $R^{18}$ are independently a hydrogen, an alkyl group, an alkenyl group, an alkynyl group, a cycloalkyl group, an aralkyl group, an aryl group and a heterocyclic group, wherein each of $R^{14}$, $R^{15}$, $R^{16}$, $R^{17}$ and $R^{18}$ may have one or more substituent groups; or any two of $R^{14}$, $R^{15}$, $R^{16}$, $R^{17}$ and $R^{18}$ may by combined together to form a five-membered or six-membered nitrogen containing heterocyclic ring;

wherein said filter dye that becomes at least about 50% colorless within about 5 minutes upon heating to a temperature of at least about 90° C.

8. The photothermographic element of claim 7 wherein said filter dye and said base precursor are both in a light-absorbing layer comprising said filter dye.

9. The photothermographic element of claim 7 wherein said base precursor is in association with one or more blocked filter dyes and the base precursor is capable of promoting the unblocking of said one or more filter dyes.

10. The photothermographic element of claim 7 wherein the dye is a barbituric acid arylidene filter dye.

11. The photothermographic element of claim 7 wherein the base precursor reacts with the filter dye at a temperature suitable for photothermographic development or below but higher than 80° C.

12. The photothermographic element of claim 7 wherein the base precursor that is a neutral or weakly basic compound which can generate a strong base during thermal processing.

13. The photothermographic element of claim 7 wherein each of $R^{14}$, $R^{15}$, $R^{16}$, $R^{17}$ and $R^{18}$ is hydrogen or an alkyl group.

14. The photothermographic element of claim 13 wherein the number of the guanidine moieties is 2.

15. The photothermographic element of claim 7 wherein the base precursor is a bisguanidine base precursor.

16. The photothermographic element of claim 7 wherein the base precursor is a bisguanidinium salts of arylsulfonylacetic acids having the following formula:

IV

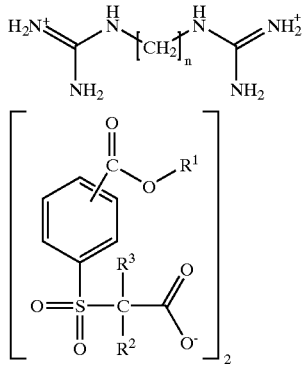

wherein the subscript n is 2 to 4.

17. The photothermographic element of claim 7 comprising a support having thereon at least one light-sensitive silver halide emulsion layer and at least one light-absorbing non-light sensitive layer comprising said filter dye.

18. The photothermographic element of claim 17 in which the base precursor is present in the amount of 0.25 times to 1.0 times the amount by weight of coated gelatin per square meter in the light-absorbing layer or in a proximate layer containing base precursor in bleaching association with the light-absorbing layer.

19. A photothermographic element according to claim 7 wherein the photothermographic element contains an imaging layer comprising a blocked developer, a light-sensitive silver halide emulsion, and a non-light sensitive silver salt oxidizing agent.

20. A photothermographic element according to claim 7 that is capable of dry development without the application of aqueous solutions.

21. A photothermographic process for preparing visible photographic images comprising the steps of:

(a) providing a photothermographic element comprising a support having coated thereon (i) at least one layer containing photosensitive silver halide, a water-insoluble organic silver salt as an oxidizing agent, a reducing agent for silver ion, and (ii) a light-absorbing layer comprising a filter dye in association with an effective amount of a base precursor according to claim 1; and (b) thermally developing the film step without any externally applied developing agent, comprising heating said film to an average temperature of at least 90° C. for at least 0.5 seconds, wherein said filter dye becomes at least about 50% colorless.

22. The photothermographic process according to claim 21 wherein thermal development is conducted under substantially dry process conditions without the application of aqueous solutions.

23. The photothermographic process of claim 21 wherein said filter layer becomes substantially colorless within 2 minutes upon heating to a temperature of at least 90° C.

24. The photothermographic process according to claim 21, wherein said development step comprises treating said imagewise exposed element at a temperature between about 100° C. and about 180° C. for a time ranging from about 0.5 to about 60 seconds.

25. The photothermographic process according to claim 21 wherein following thermal development the element is scanned to form a first electronic image representation of the developed image in the element and an image is formed on another recording material based on the image information.

* * * * *